US007213277B1

(12) United States Patent
Hsieh

(10) Patent No.: US 7,213,277 B1
(45) Date of Patent: May 8, 2007

(54) ROCKING BED

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 11/264,635

(22) Filed: Nov. 1, 2005

(51) Int. Cl.
*A45F 3/22* (2006.01)

(52) U.S. Cl. ..... 5/101; 5/105; 5/127; 5/129

(58) Field of Classification Search ..... 5/101, 5/105, 107, 125, 127; 297/271.5, 271.6
See application file for complete search history.

(56) References Cited

U.S. PATENT DOCUMENTS 2,854,062 A * 9/1958 Hetchler ..... 297/270.3
3,890,660 A * 6/1975 Pedler ..... 5/101
4,919,481 A * 4/1990 Garabedian ..... 297/271.6
4,997,234 A * 3/1991 Royle et al. ..... 297/271.6

* cited by examiner

*Primary Examiner*—Michael Trettel
(74) *Attorney, Agent, or Firm*—Seyfarth Shaw LLP; Timothy J. Keefer

(57) ABSTRACT

A rocking bed includes: a bed frame including two curved rods, each of which has first and second ends, a first section extending from the first end, and a second section extending from the first section to the second end, the first section having a curvature greater than that of the second section, and two connecting rods, each of which interconnects the curved rods; and a body-supporting member mounted securely on the bed frame and extending between the curved rods and between the connecting rods.

3 Claims, 6 Drawing Sheets

ROCKING BED

BACKGROUND OF THE INVENTION

1. Field of the Invention

The invention relates to a rocking bed, more particularly to a rocking bed with two curved rods, each of which has sections with different degrees of curvature.

2. Description of the Related Art

As shown in FIGS. 1 and 2, a conventional rocking bed 1 includes two curved rods 11, two connecting rods 12, each of which interconnects a respective pair of ends of the curved rods 11, and a body-supporting member 13 mounted securely on the connecting rods 12 and extending between the curved rods 11 and between the connecting rods 12.

The curved rods 11 of the conventional rocking bed 1 have a uniform curvature. When the rocking bed 1 is not in use, the entire rocking bed 1 is in a balanced state (see FIG. 1), i.e., the body-supporting member 13 is substantially horizontal relative to the ground. Since the upper body of a person normally has a weight greater than that of the lower body, when the user 100 lies on the body-supporting member 13, the rocking bed 1 inclines downwardly at one end thereof that supports the upper body of the user 100, as best shown in FIG. 2, which can result in undesired sliding of the body of the user 100 on the body-supporting member 13 and in user discomfort.

Referring to FIG. 3, to overcome the aforesaid drawback, another conventional rocking bed 2 has been proposed. The rocking bed 2 includes connecting rods 12 different from those of the rocking bed 1 of FIG. 1 in that one of the connecting rods 12 is solid and the other one is hollow. Therefore, one end of the rocking bed 2 is heavier than the other end of the rocking bed 2 such that the body-supporting member 13 can be at a horizontal state when the user 100 lies thereon. However, the manufacturing costs and the overall weight of the rocking bed 2 thus formed are undesirably increased.

SUMMARY OF THE INVENTION

Therefore, the object of the present invention is to provide a rocking bed capable of overcoming the aforesaid drawbacks associated with the prior art.

Accordingly, a rocking bed of the present invention comprises: a bed frame including two curved rods, each of which has first and second ends, a first section extending from the first end, and a second section extending from the first section to the second end, the first section having a curvature greater than that of the second section, and two connecting rods, each of which interconnects the curved rods; and a body-supporting member mounted securely on the bed frame and extending between the curved rods and between the connecting rods.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
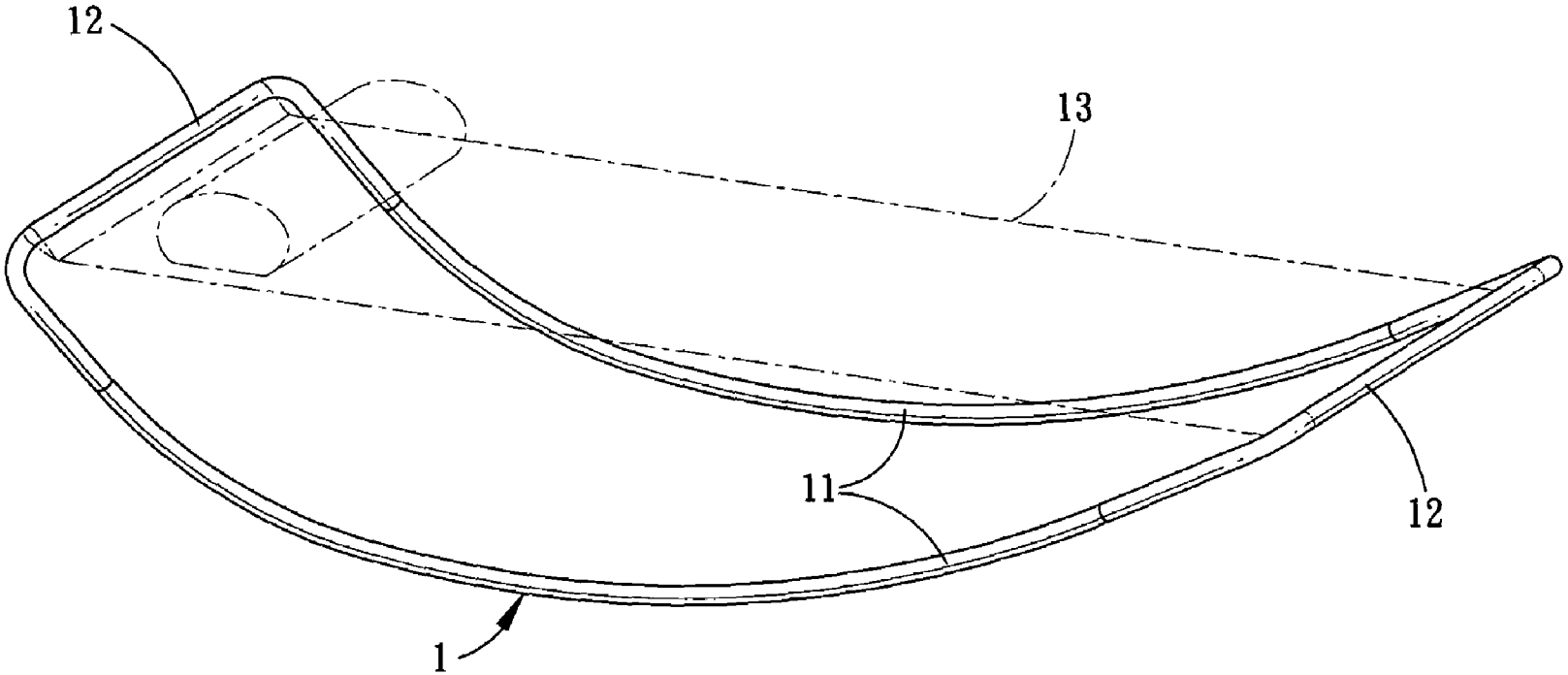
FIG. 1 PRIOR ART
FIG. 1 is a perspective view of a conventional rocking bed.
Figure 2:
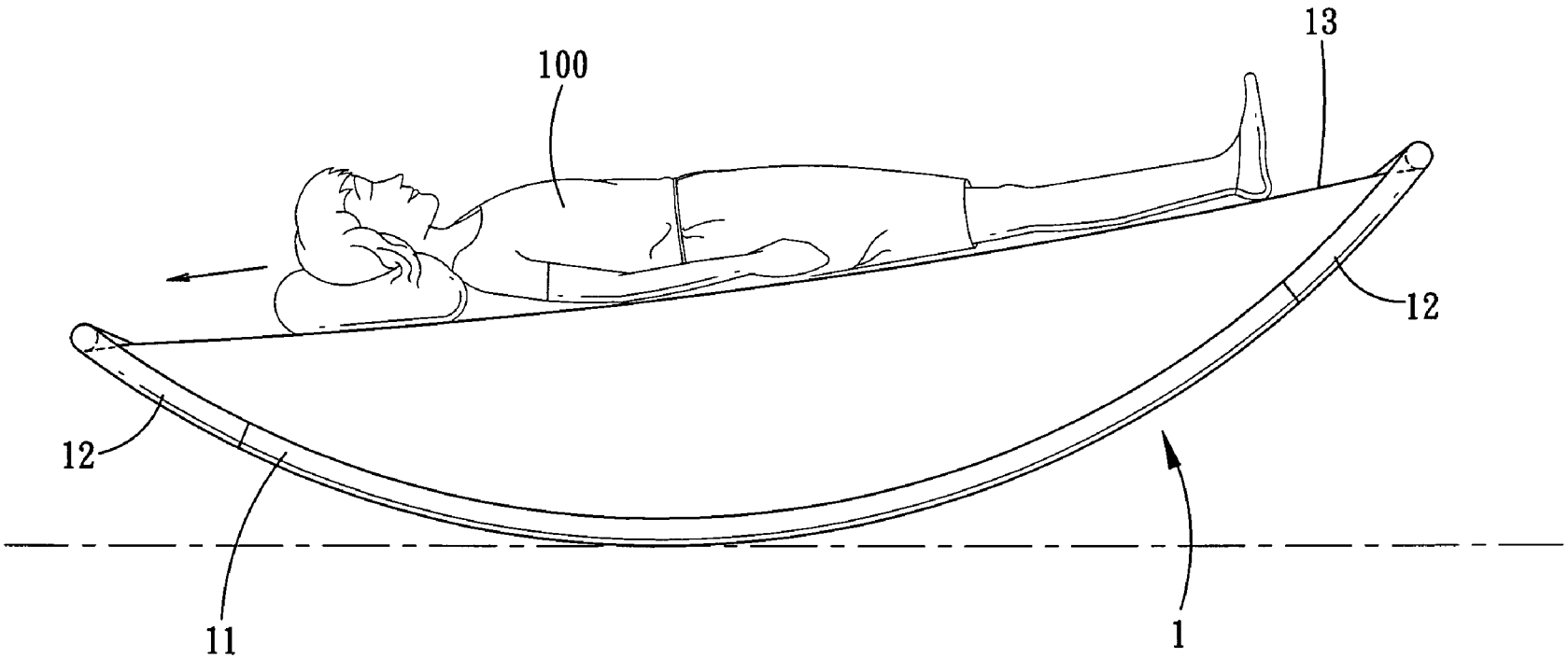
FIG. 2 PRIOR ART
FIG. 2 is a schematic side view to illustrate an inclined state of the conventional rocking bed of FIG. 1 when the user lies thereon.
Figure 3:
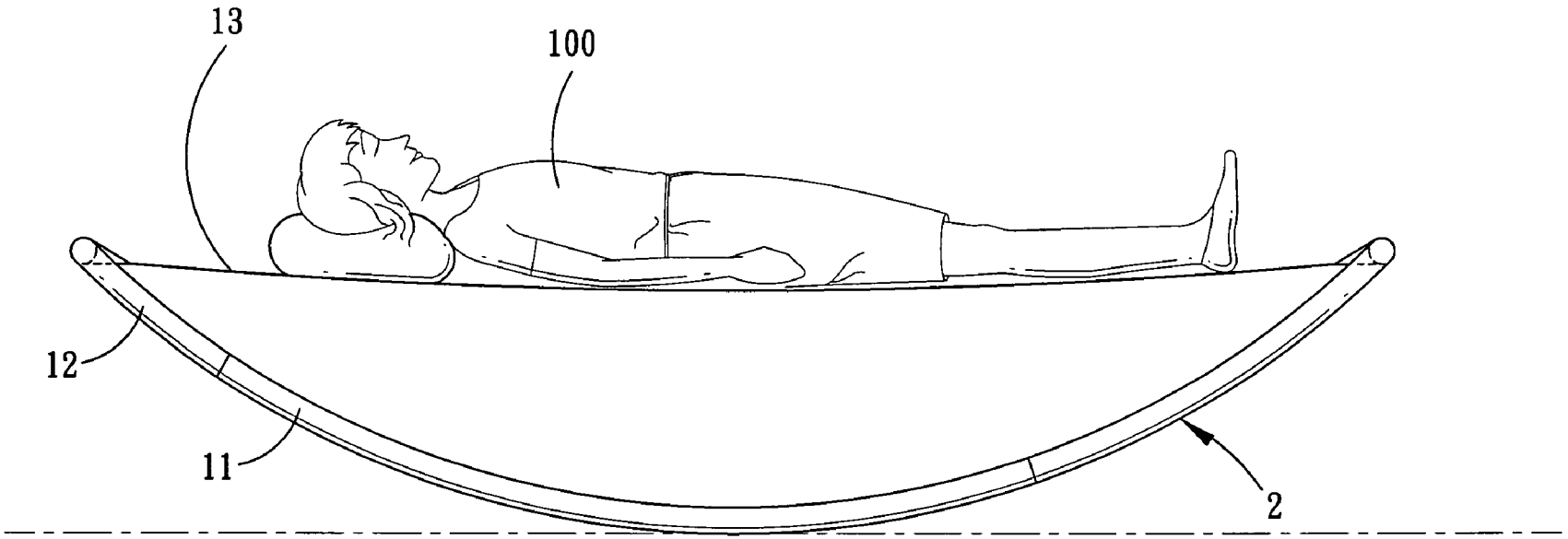
FIG. 3 PRIOR ART
FIG. 3 is a schematic side view of another conventional rocking bed.
Figure 4:
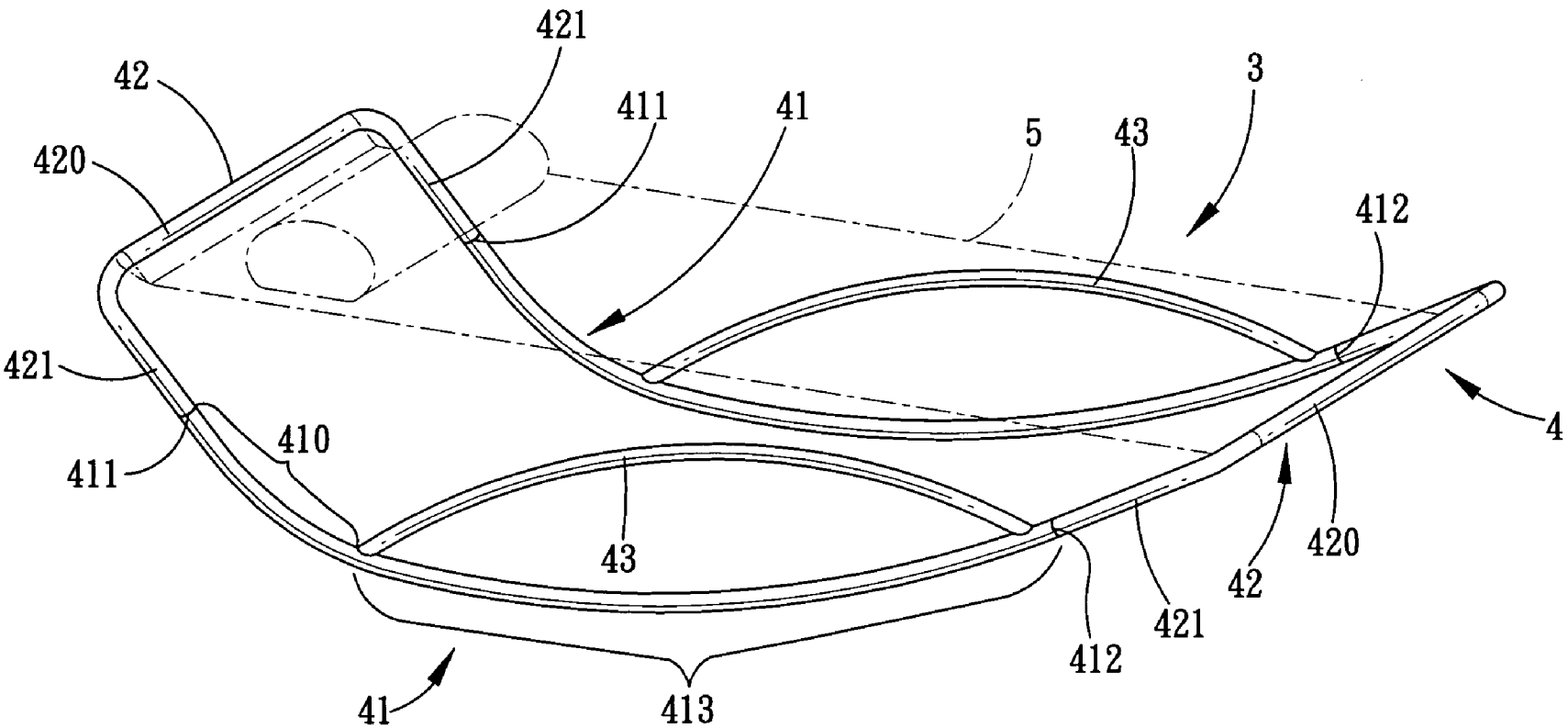
FIG. 4 is a perspective view of the preferred embodiment of a rocking bed according to the present invention.

Referring to FIG. 4, the preferred embodiment of a rocking bed 3 according to the present invention is shown to include: a bed frame 4 including two curved rods 41, each of which has first and second ends 411, 412, a first section 410 extending from the first end 411, and a second section 413 extending from the first section 410 to the second end 412, the first section 410 having a curvature greater than that of the second section 413 (best shown in FIG. 5), and two connecting rods 42, each of which interconnects the curved rods 41; and a body-supporting member 5 mounted securely on the bed frame 4 and extending between the curved rods 41 and between the connecting rods 42.

Each of the connecting rods 42 is U-shaped, and includes a main rod section 420, and a pair of end sections 421 extending from respective ends of the main rod section 420 and connected to a respective pair of the first and second ends 411, 412 of the curved rods 41.

Figure 5:
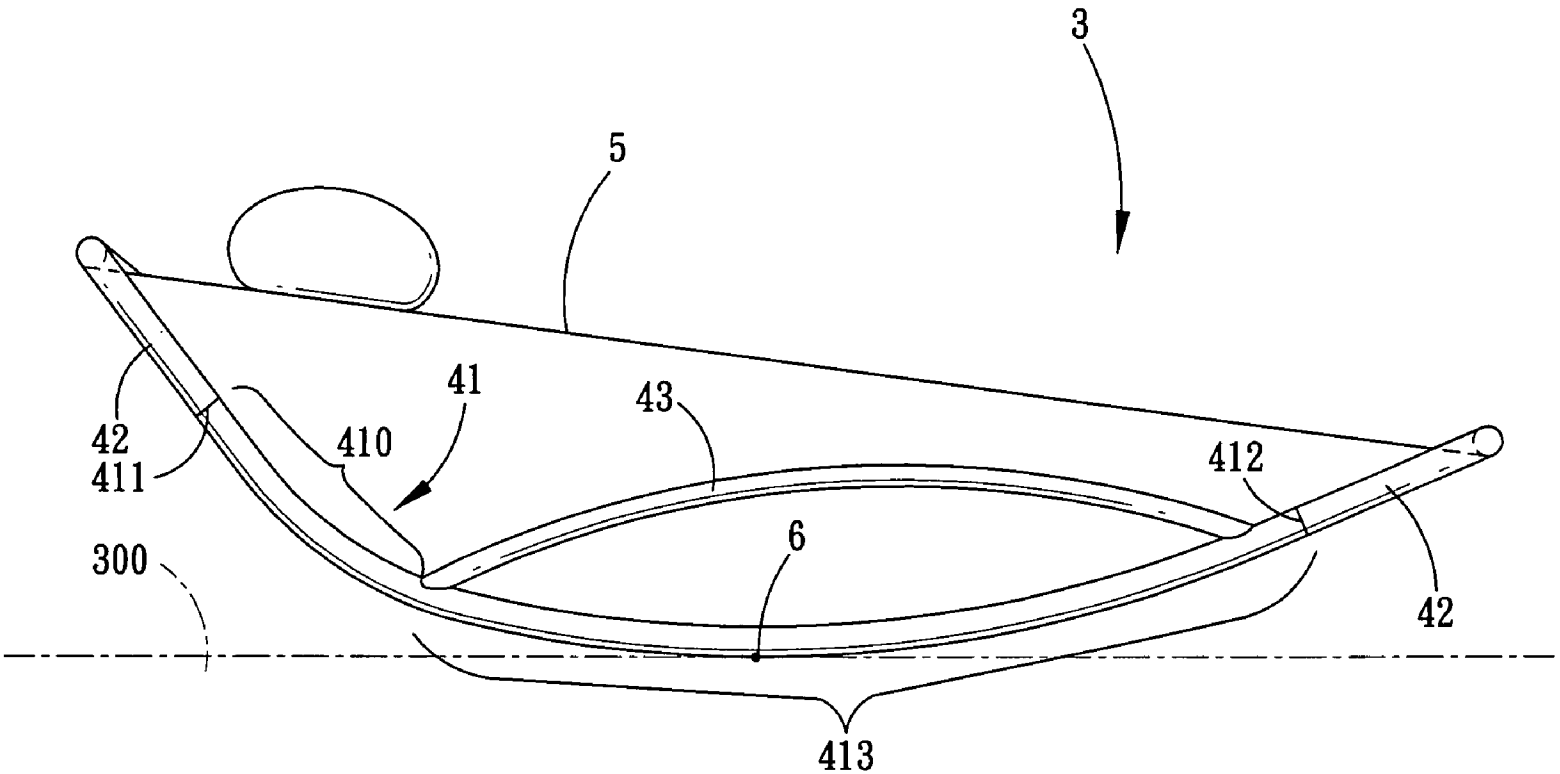
FIG. 5 is a schematic side view of the preferred embodiment when in an idle state.

In this embodiment, as shown in FIG. 5, the length of the first section 410 of each of the curved rods 41 is less than that of the second section 413 of each of the curved rods 41.

In this embodiment, the body-supporting member 5 includes a fabric sheet having two end portions that are secured to the connecting rods 42, respectively. As shown in FIG. 4, the two end portions of the fabric sheet are respectively formed into loops and are sleeved on the main rod sections 420 of the connecting rods 42, respectively.

Preferably, the rocking bed 3 further includes a pair of armrest parts 43, each of which is mounted securely on a respective one of the curved rods 41, and is arcuate in shape. In this embodiment, the two opposite ends of each of the armrest parts 43 are connected to two ends of the second section 413 of the respective one of the curved rods 41.

Referring to FIG. 5, when the rocking bed 3 is in an idle state, since the curvature of the first sections 410 of the curved rods 41 is larger than that of the second sections 413, the connecting rod 42 that is connected to the first ends 411 of the curved rods 41 has a height greater than that of the connecting rod 42 that is connected to the second ends 412 of the curved rods 41, and the body-supporting member 5 is disposed in an inclined state relative to the ground 300. At this time, the rocking bed 3 has a lowest point 6 in contact with the ground 300.

Figure 6:
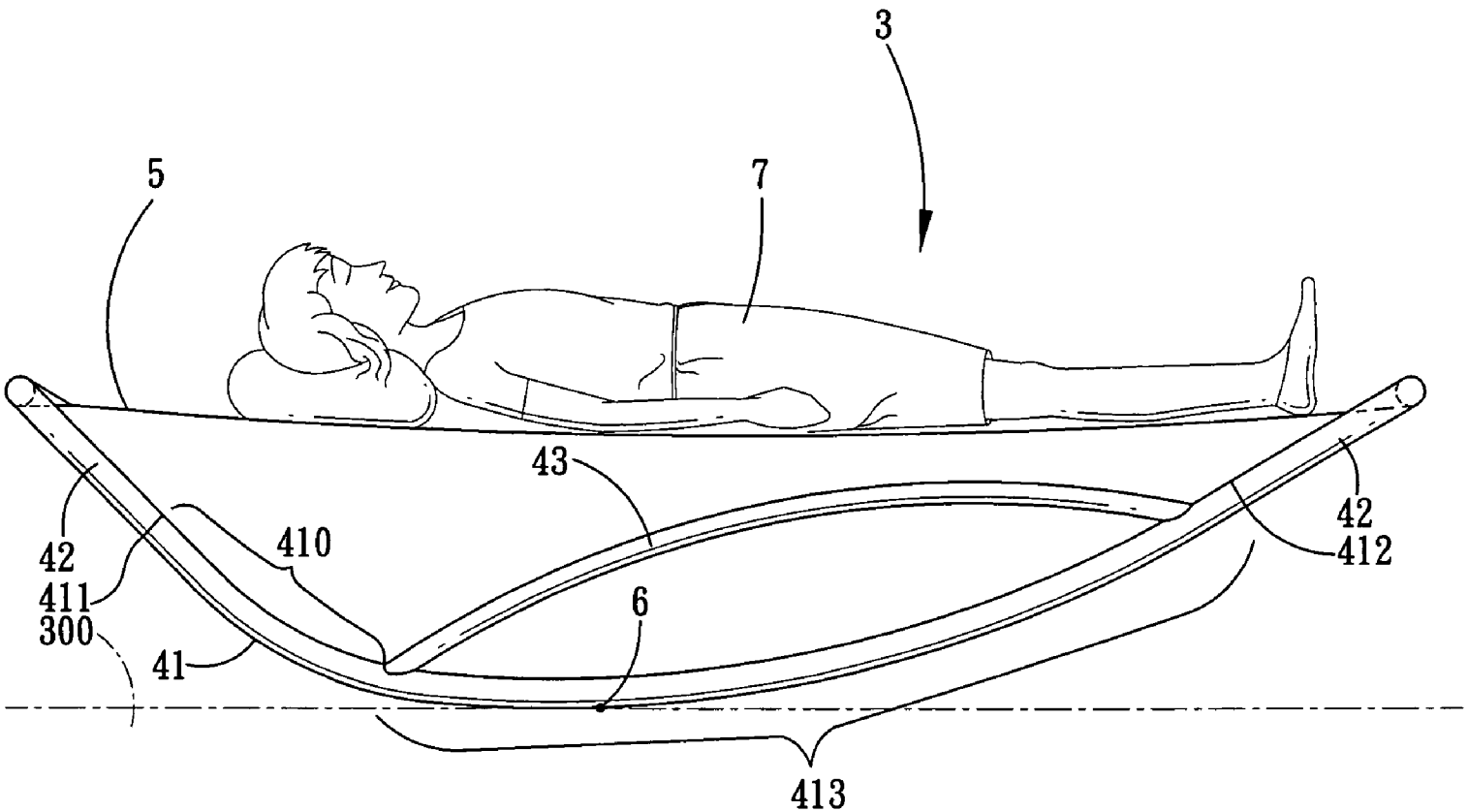
FIG. 6 is a schematic side view of the preferred embodiment when in a state of use.

Referring to FIG. 6, when the user 7 lies on the body-supporting member 5 of the rocking bed 3, due to the heavier weight of the upper body of the user 7 than the lower body of the user 7, the lowest point 6 is shifted in a direction toward the first ends 411 of the curved rods 41 such that the body-supporting member 5 is tilted to a horizontal state relative to the ground 300.

By making the first and second sections 410, 413 of the curved rods 41 have different curvatures, the aforesaid drawbacks associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A rocking bed comprising:

a bed frame including two curved rods, each of which has first and second ends, a first section extending from said first end, and a second section extending from said first section to said second end, said first section having a curvature greater than that of said second section, the length of said first section of each of said curved rods is less than that of said second section of each of said curved rods, and two connecting rods, each of which interconnects said curved rods;

a body-supporting member mounted securely on said bed frame and extending between said curved rods and between said connecting rods; and a pair of armrest parts, each of which is mounted securely on a respective one of said curved rods;

wherein each of said armrest parts is arcuate in shape.

2. The rocking bed as claimed in claim 1, wherein said body-supporting member includes a fabric sheet having two end portions that are secured to said connecting rods, respectively.

3. The rocking bed as claimed in claim 2, wherein each of said connecting rods is U-shaped, and has two opposite end sections connected to a respective pair of said first and second ends of said curved rods.

* * * * *